US005919352A

United States Patent [19]

Serrand et al.

[11] Patent Number: 5,919,352

[45] **Date of Patent: *Jul. 6, 1999**

[54] INTEGRATED RESIDUA UPGRADING AND FLUID CATALYTIC CRACKING

[75] Inventors: Willibald Serrand, Buxheim, Germany; David G. Hammond, Madison, N.J.; Mitchell Jacobson, West Orange, N.J.; John F. Pagel, Cedar Knolls, N.J.; Martin C. Poole, League City, Tex.

[73] Assignee: Exxon Research and Engineering Co., Florham Park, N.J.

[ * ] Notice: This patent is subject to a terminal disclaimer.

[21] Appl. No.: 08/895,710

[22] Filed: Jul. 17, 1997

Related U.S. Application Data

[63] Continuation-in-part of application No. 08/503,291, Jul. 17, 1995, abandoned.

[51] Int. Cl.[6] ..... C10G 55/06

[52] U.S. Cl. ..... 208/91; 208/52 CT; 208/55; 208/88; 208/127; 208/251 R; 208/299

[58] Field of Search ..... 208/55, 52 CT, 208/88, 91, 251 R, 127, 299

[56] References Cited

U.S. PATENT DOCUMENTS

| | | | |
|---|---|---|---|
| 4,243,514 | 1/1981 | Bartholic | 208/91 |
| 4,263,128 | 4/1981 | Bartholic | 208/91 |
| 4,374,021 | 2/1983 | Bartholic | 208/251 R |
| 4,435,272 | 3/1984 | Bartholic et al. | 208/127 |
| 4,551,229 | 11/1985 | Pecoraro et al. | 208/76 |
| 4,569,754 | 2/1986 | Moore | 208/91 |
| 4,915,820 | 4/1990 | Hettinger, Jr. | 208/253 |
| 5,658,455 | 8/1997 | Hammond et al. | 208/127 |
| 5,714,056 | 2/1998 | Hammond et al. | 208/127 |
| 5,714,663 | 2/1998 | Serrand et al. | 585/648 |

OTHER PUBLICATIONS

H. Weiss et al., "Coking of Residue Oils by the LR–Process", Sonderdruck aus Erdol & Kohle–Erdgas–Petrochemie/Hydrocarbon Technology 42, 235–237, 1989.

H.J. Weiss et al., "Coking of Oil Sand, Asphaltenes and Residual Oils in the LR–Process", (paper #144) Fourth UNITAR/UNDP Intl. Conf. on Heavy Crude & Tar Sand, No date.

H. Weiss et al., "Coking of Oil Sands, Asphaltenes and Residual Oils in the LR–Process" paper presented at the 5th UNITAR Conference, Aug. 9, 1988.

*Primary Examiner*—Walter D. Griffin

[57] ABSTRACT

A process wherein a residuum feedstock is upgraded in a short vapor contact time thermal process unit comprised of a horizontal moving bed of fluidized hot particles, then fed to a fluid catalytic cracking process unit. Hot flue gases from the fluid catalytic cracking unit is used to circulate solid particles and to provide process heat to the thermal process unit.

9 Claims, 1 Drawing Sheet

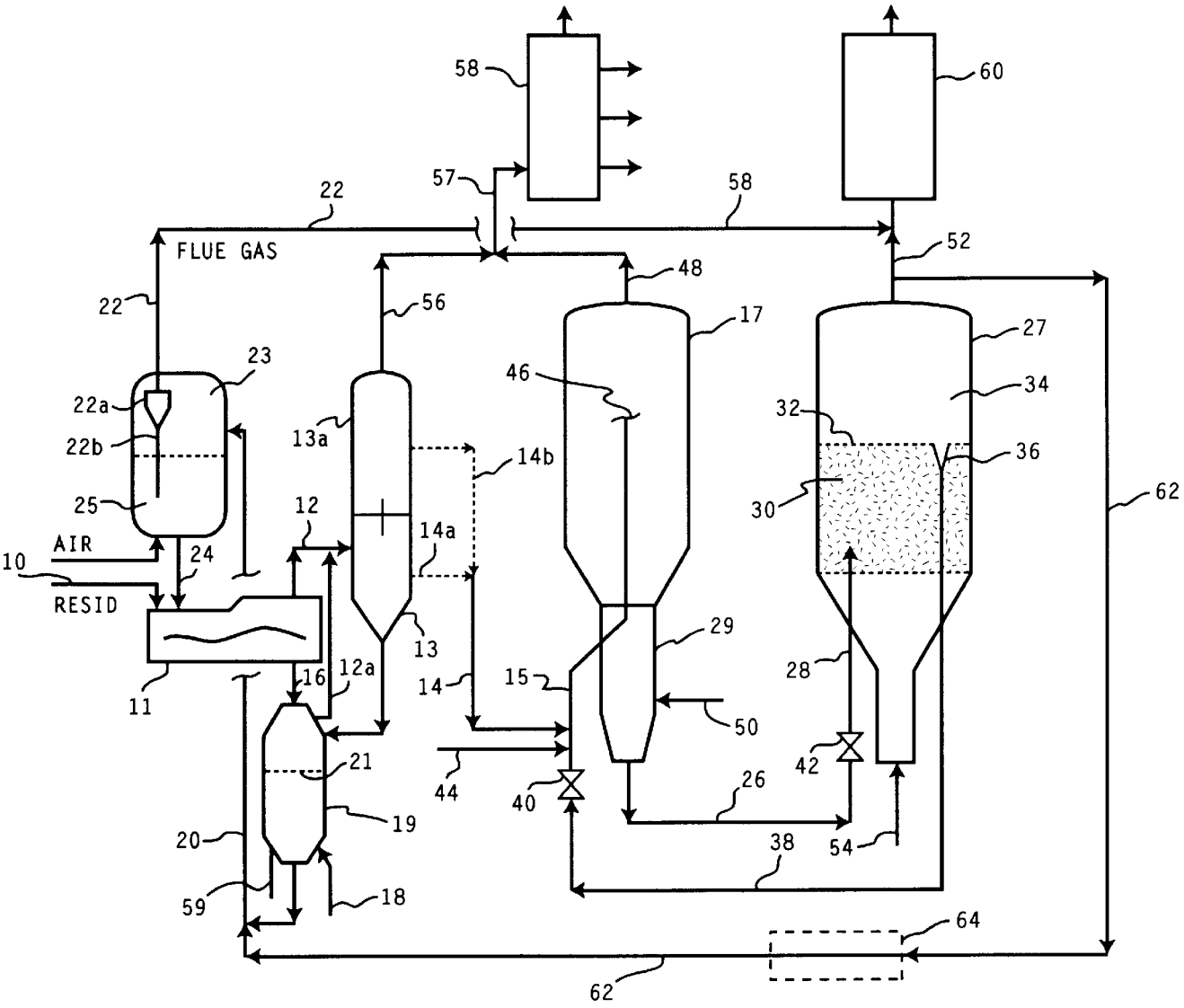
FLUE GAS
AIR
RESID

INTEGRATED RESIDUA UPGRADING AND FLUID CATALYTIC CRACKING

CROSS REFERENCE TO RELATED APPLICATIONS

This is a continuation-in-part of U.S. Ser. No. 08/503,291 filed Jul. 17, 1995, now abandoned.

FIELD OF THE INVENTION

The present invention relates to a process wherein a residuum feedstock is upgraded in a short vapor contact time thermal process unit comprised of a horizontal moving bed of fluidized hot particles, then fed to a fluid catalytic cracking process unit. Hot flue gases from the fluid catalytic cracking unit is used to circulate solid particles and to provide process heat to the thermal process unit.

BACKGROUND OF THE INVENTION

Although refineries produce many products, the most desirable are the transportation fuels gasolines, diesel fuels, and jet fuels, as well as light heating oils, all of which are high-volume, high value products. While light heating oils are not transportation fuels, their hydrocarbon components are interchangeable with diesel and jet fuels, differing primarily in their additives. Thus, it is a major objective of petroleum refineries to convert as much of the barrel of crude oil into transportation fuels as is economically practical. The quality of crude oils is expected to slowly worsen with increasing levels of sulfur and metals content and higher densities. Greater densities mean that more of the crude oil will boil above about 560° C., and thus will contain higher levels of Conradson Carbon and/or metal components. Historically, this high-boiling material, or residua, has been used as heavy fuel oil, but the demand for these heavy fuel oils has been decreasing because of stricter environmental requirements. This places greater emphasis on refineries to process the entire barrel of crude to more valuable lower boiling products.

The most important and widely used refinery process for converting heavy oils into more valuable gasoline and lighter products is fluid catalytic cracking, "FCC". FCC converts heavy feeds, primarily gas oils, into lighter products by catalytically cracking larger molecules into smaller molecules. FCC catalysts, having a powder consistency, circulate between a cracking reactor and a catalyst regenerator. Hydrocarbon feedstock contacts hot regenerated catalyst in the cracking reactor where it vaporizes and cracks at temperatures from about 420° C. to about 590° C. The cracking reaction causes combustible carbonaceous hydrocarbons, or coke, to deposit on the catalyst particles, thereby resulting in deactivation of the catalyst. The cracked products are separated from the coked catalyst. The coked catalyst is stripped of volatiles, typically with steam, in a stripping zone. The stripped catalyst is then sent to a regenerator where it is regenerated by burning coke from the catalyst with an oxygen containing gas, preferably air. During regeneration, the catalyst is heated to relatively high temperatures and is recycled to the reactor where it contacts and cracks fresh feedstock. CO-containing flue gas formed by burning coke in the regenerator may be treated for removal of particulates and for conversion of carbon monoxide, after which the flue gas is normally discharged into the atmosphere.

Typical fluid catalytic cracking feedstocks are gas oils having a boiling range from about 315° C. to about 560° C.

Feedstocks boiling in excess of about 560° C., typically vacuum and atmospheric resids, are usually high in Conradson Carbon residues and metal compounds, such as nickel and vanadium, which are undesirable as FCC feedstocks. There is increasing pressure to use greater amounts of such heavy feeds as an additional feed to FCC units. However, two major factors have opposed this pressure, namely, the Conradson Carbon residues and metal values of the residua. As the Conradson Carbon residues and metal values have increased in feeds charged to FCC units, capacity and efficiency of FCC units have been adversely affected. High Conradson Carbon residues in FCC feedstocks has resulted in an increase in the portion of feedstock converted to "coke" deposits on the surface of FCC catalysts. As coke builds up on the catalyst, the active surface of the catalyst is rendered inactive for the desired activity. This additional coke build-up also presents problems in the regeneration step when coke is burned-off because the burning of additional coke can cause the temperature in the regenerator to increase to levels which will damage the catalyst. Thus, as the Conradson Carbon residues in feedstocks have increased, coke burning capacity has become a bottle-neck, thereby resulting in a reduction in the rate at which feedstocks are charged to the FCC unit. In addition, part of the feedstock would inevitably be diverted to undesirable, less valuable reaction products.

Furthermore, metals, such as nickel and vanadium, in FCC feedstocks have tended to catalyze the production of coke and hydrogen. Such metals have also tended to be deposited and accumulated on the catalyst as the molecules in which they occur are cracked. This has further increased coke production with its accompanying problems. Excessive hydrogen production has also caused a bottle-neck in processing lighter ends of cracked products through fractionation equipment to separate valuable components, primarily propane, butane and olefins of like carbon number. Hydrogen, being incondensible in a "gas plant", has occupied space as a gas in the compression and fractionation train and has tended to overload the system when excessive amounts are produced by high metal content catalysts. This has required a reduction in charge rates to maintain FCC units and their auxiliaries operative.

These problems have long been recognized in the art. Various methods have been proposed to reduce the Conradson Carbon residue, and metal-containing components in feedstocks, such as resids, before they are sent to an FCC process unit. For example, coking is used to convert high Conradson Carbon and metal-containing components of resids to coke and to a vaporized fraction that includes the more valuable lower boiling products. The two types of coking most commonly commercially practiced are delayed coking and fluidized bed coking. In delayed coking, the resid is heated in a furnace and passed to large drums maintained at temperatures from about 415° C. to 450° C. During a long residence time in the drum at such temperatures, the resid is converted to coke. Liquid products are taken off the top for recovery as "coker gasoline", "coker gas oil", and gas. Conventional fluidized bed coking process units typically include a coking reactor and a burner. A petroleum feedstock is introduced into the coking reactor containing a fluidized bed of hot, fine, inert particles (coke), and is distributed uniformly over the surfaces of the particles where it is cracked to vapors and coke. The vapors pass through a cyclone which removes most of the entrained particles. The vapor is then discharged into a scrubbing zone where the remaining coke particles are removed and the products are cooled to condense heavy liquids. A slurry fraction, which usually contains from about 1 to about 3 wt. % coke particles, is recycled to extinction in the coking zone.

While resid can be upgraded in petroleum refineries to meet the criteria as an FCC feed, there is still a substantial need in the art for more efficient and cost effective methods for achieving this upgrading. There is also a need to increase the amount of liquid products and to decrease the amount of gas and/or coke make when upgrading such feedstocks.

SUMMARY OF THE INVENTION

In accordance with the present invention there is provided a two stage process for converting a residua feedstock to lower boiling products wherein the first stage is an upgrading stage wherein the Conradson Carbon content and metals content of a residua feedstock is lowered and the second stage is a catalytic cracking stage containing a reactor and a catalyst regenerator, wherein the upgrading is performed in a short vapor contact time thermal process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 450° C. to about 650° C. and operated under conditions such that the solids residence time is from about 5 to about 60 seconds and the vapor residence time is less than about 2 seconds; and (iii) a stripping zone through which solids having carbonaceous deposits thereon are passed from the reaction zone and wherein lower boiling additional hydrocarbon and volatiles are stripped with a stripping gas;

which process comprises:

(a) feeding the residua feedstock, in liquid form, to the short vapor contact time reaction zone wherein it contacts fluidized hot solids, thereby depositing high Conradson Carbon components and metal-containing components thereon, and producing a vaporized product stream;

(b) separating the vaporized product stream from the fluidized solids;

(c) feeding said vaporized product stream to a fluid catalytic cracking reactor where they are catalytically converted to lower boiling products;

(d) passing the solids to said stripping zone where they are contacted with a stripping gas, thereby removing volatile components therefrom;

(e) passing the stripped solids to a heating zone along with CO-containing flue gas from the fluid catalytic cracker regenerator, where they are heated to a temperature effective to maintain the heat requirements of the short vapor contact time reaction zone; and (f) recycling hot solids from the heating zone to the reaction zone where they are contacted with fresh feedstock.

In a preferred embodiment of the present invention, the vaporized product stream from the short vapor contact time process unit is quenched to a temperature below which substantial thermal cracking occurs.

BRIEF DESCRIPTION OF THE FIGURE

The sole figure hereof is a schematic flow plan of a preferred embodiment of the present invention.

DETAILED DESCRIPTION OF THE INVENTION

Residua feedstocks which are upgraded in accordance with the present invention are those petroleum fractions which are liquid at process conditions and which have average boiling points above about 480° C., preferably above about 540° C., more preferably above about 560° C. Non-limiting examples of such fractions include vacuum resids, atmospheric resids, heavy and reduced petroleum crude oil; pitch; asphalt; bitumen; tar sand oil; shale oil; and coal liquefaction bottoms. Preferred are vacuum resids, atmospheric reside and heavy and reduced petroleum crude oil. It is understood that such resids may also contain minor amount of lower boiling material. These feedstocks cannot be fed to an FCC unit in substantial quantity because they are typically high in Conradson Carbon and contain an undesirable amount of metal-containing components. Conradson Carbon residues deposit on the FCC cracking catalyst and causes excessive deactivation. Metals, such as nickel and vanadium also deactivate the catalyst by acting as catalyst poisons. Such feeds will typically have a Conradson carbon content of at least 5 wt. %, generally from about 5 to 50 wt. %. As to Conradson carbon residue, see ASTM Test D189-165.

Residuum feedstocks are upgraded in accordance with the present invention in a selective short vapor contact time process unit which is comprised of a heating zone, a short vapor contact time horizontal fluidized bed reaction zone and a stripping zone. Reference is now made to the sole figure hereof wherein a residual feedstock which is high in Conradson Carbon and/or metal-components is fed via line 10 to short vapor contact time reaction zone 11 which contains a horizontal moving bed of fluidized hot solids. It is preferred that the particles in the short vapor contact time reactor be fluidizing with assistance by a mechanical means. The particles are fluidized by use of a fluidized gas, such as steam, a mechanical means, and by the vapors which result in the vaporization of a fraction of the feedstock. It is preferred that the mechanical means be a mechanical mixing system characterized as having a relatively high mixing efficiency with only minor amounts of axial backmixing. Such a mixing system acts like a plug flow system with a flow pattern which ensures that the residence time is nearly equal for all particles. The most preferred mechanical mixer is the mixer referred to by Lurgi AG of Germany as the LR-Mixer or LR-Flash Coker which was originally designed for processing for oil shale, coal, and tar sands. The LR-Mixer consists of two horizontally oriented rotating screws which aid in fluidizing the particles. Although it is preferred that the solid particles be coke particles, they may be any other suitable refractory particulate material. Non-limiting examples of such other suitable refractory materials include those selected from the group consisting of silica, alumina, zirconia, magnesia, or mullite, synthetically prepared or naturally occurring material such as pumice, clay, kieselguhr, diatomaceous earth, bauxite, and the like. In a preferred embodiment, the solids are substantially inert, such that the instant process is substantially a thermal process as opposed to a catalytic process. That is, no catalysts are intentionally added during this process, although it is within the scope of the present invention that the solids may have some limited catalytic properties owing to metals which may inherently be in the feedstock. The solids will have an average particle size of about 40 microns to 2,000 microns, preferably from about 50 microns to about 800 microns.

When the feedstock is contacted with the fluidized hot solids, which will preferably be at a temperature from about 550° C. to about 760° C., more preferably from about 600° C. to 700° C., a substantial portion of the high Conradson Carbon and metal-containing components will deposit on the hot solid particles in the form of high molecular weight carbon and metal moieties. The remaining portion will be vaporized on contact with the hot solids. The residence time of vapor products in reaction zone 11 will be an effective amount of time so that substantial secondary cracking does not occur. This amount of time will typically be less than about 2 seconds, preferably less than about 1 second, and more preferably less than about 0.5 seconds. The residence time of solids in the reaction zone will be from about 5 to 60 seconds, preferably from about 10 to 30 seconds. One novel aspect of the present invention is that the residence time of the solids and the residence time of the vapor products, in the reaction zone, are independently controlled. Most fluidized bed processes are designed so that the solids residence time, and the vapor residence time cannot be independently controlled, especially at relatively short vapor residence times. It is preferred that the short vapor contact time process unit be operated so that the ratio of solids to feed be from about 10 to 1, preferably from about 5 to 1. It is to be understood that the precise ratio of solids to feed will primarily depend on the heat balance requirement of the short vapor contact time reaction zone. Associating the oil to solids ratio with heat balance requirements is within the skill of those having ordinary skill in the art, and thus will not be elaborated herein any further. A minor amount of the feedstock will deposit on the solids in the form of combustible carbonaceous material. Metal components will also deposit on the solids. Consequently, the vaporized portion will be substantially lower in both Conradson Carbon and metals when compared to the original feed.

The vaporized portion is passed via line 12 to cyclone 13 where most of the entrained solids, or dust, is removed. One option is to pass the dedusted stream, via lines 14*a* and 14, directly to riser 15 of FCC reactor 17. Another option is to pass the dedusted vapors overhead to quench tower 13*a* where the vapors are reduced to temperatures below which substantial thermal cracking will occur. This temperature will preferably be below about 450° C., more preferably below about 340° C. The quenched stream can then be fed via lines 14*b* and 14 into the riser 15 of FCC reactor 17. An overhead stream is passed via lines 56 and 57 from quench tower 13*a* to FCC fractionator 58. Solids, having carbonaceous material deposited thereon, are passed from reaction zone 11 via line 16 to stripper 19 which contains stripping zone 21 where any remaining volatiles, or vaporizable material, are stripped from the solids with use of a stripping gas, preferably steam, introduced into stripper via line 18. Stripped vapor products are passed via line 12*a* to cyclone 13. The stripped solids are passed via line 20 to heater 23 which contains heating zone 25. The heating zone is operated in an oxidizing gas environment, preferably air, at an effective temperature. That is, at a temperature that will meet the heat requirements of the reaction zone. The heating zone will typically be operated at a temperature of about 40° C. to 200° C., preferably from about 65° C. to 175° C., more preferably from about 65° C. to 120° C. in excess of the operating temperature of reaction zone 11. It is understood that preheated air can be introduced into the heater. The heater will typically be operated at a pressure ranging from about 0 to 150 psig, preferably at a pressure ranging from about 15 to about 45 psig. While some carbonaceous residue will be burned from the solids in the heating zone, it is preferred that only partial combustion take place so that the solids, after passing through the heater, will have value as a fuel. Excess solids can be removed from the process unit via line 59 from stripper 19. Flue gas is removed from burner 23 via line 22. Flue gas is passed through a cyclone system 22*a* to remove most solid fines. Dedusted flue gas will be further cooled in a waste heat recovery system (not shown), scrubbed to remove contaminants and particulates, and passed to CO boiler 60. The hot inert solids including entrained solids via line 22*b* from cyclone system 22*a* are then recycled via line 24 to thermal zone 11.

The FCC unit can be any conventional FCC process unit and its specific configuration is not critical to the present invention. For illustrative purposes, a simplified FCC process unit is represented in the figure hereof. In this figure, the FCC process unit is comprised of a reactor 17 which surmounts stripper 29, the bottom of which communicates via line 26 with an upwardly-extending riser 28, the top of which is located within catalyst regenerator 27 at a level above the conical bottom thereof. The regenerator contains fluidized particles of cracking catalyst in a bed 30 which extends to a top level 32. Catalyst which tends to rise above level 32 will overflow into the region 34 of a downcomer 36 which is connected at one end to line 38. Any conventional fluid catalytic cracking catalyst can be used in the practice of the present invention. Such catalysts include those which are comprised of a zeolite in an amorphous inorganic matrix. FCC catalysts are well known in the art and further discussion herein is not needed. The other end of line 38 is connected to riser 15 which extends substantially vertically and generally upwardly to a termination device 46 at its top end to define the upper limit of the riser. Each line 26 and 38 has respective closure valves 40 and 42 for emergency and maintenance closing of the flow passages.

In broad terms, the operation of the FCC process unit proceeds as follows: a hydrocarbon feed, usually consisting of, or containing, fractions boiling in the gas oil range or higher, is passed into a lower part of riser 15 from feed line 44. The gas oils include both light and heavy gas oil and typically cover the boiling range from about 340° C. to about 560° C. Hot regenerated catalyst particles passing upwardly through riser 15 mix with, and heat, the injected feed in the riser at the level of feed injection and even higher causing selective catalytic conversion of the feed to cracked products, which include vapor-phase cracked products, and carbonaceous and tarry combustible cracked products which deposit on, and within the pores of, the catalyst particles. The feed is usually atomized to dispersed liquid droplets by steam which is passed into feed injectors (not shown) from a steam manifold (not shown). The mixture of catalyst particles and vapor-phase products enters reactor 17 from riser 15 via horizontal apertures (not shown) in termination device 46 which promotes separation of solids from vapors in the reactor. Vapors, together with entrained catalyst solids pass into a cyclone separation system (not shown) wherein most of the entrained solids are removed and returned to the catalyst bed. The solids depleted vapors are collected overhead via line 48 and passed to FCC fractionator 58.

The catalyst particles from riser 15, together with separated solids from the cyclone system, pass downwardly into the top of stripper 29 wherein they are contacted by upwardly-rising steam injected from line 50 near the base thereof. The steam strips the particles of occluded strippable hydrocarbons, and these, together with the stripping steam, are recovered with the cracked products in product line 48. The stripped catalyst particles bearing the combustible deposits circulate from the conical base of the stripper 29 via line 26 and riser 28 into the bed 30 of catalyst particles contained in regenerator 27. The catalyst particles in bed 30 are fluidized by air which is introduced into the base of the regenerator via line 54. The air oxidatively removes carbonaceous deposits from the particles and the heat of reaction (e.g. combustion and/or partial combustion) raises the temperature of the particles in the bed to temperatures suitable for cracking the feed hydrocarbons. Hot regenerated catalyst overflows the top region of 34 of downcomer 36 and passes into line 38 for contact in riser 15 with further quantities of feed supplied from line 44. The spent air passing upwardly from the top level 32 of the bed 30 in regenerator 27 enters a cyclone system (not shown) for separating entrained solids. A fraction of the hot regenerator off gas is passed to CO boiler 60 via line 52. Another fraction is recycled via line 62 to help transport stripped solids in line 20, which are passed to heater 23. The hot CO-containing regenerator off-gas, which will be at a temperature from about 650° to 750° C., also provides heat to heater 23. Further, the CO-containing regenerator off-gas can be first combusted in combustion zone 64 to a temperature up to about 1200° C. to provide even more process heat to the process. Consequently, the thermal stage and the fluid catalytic cracking stage are integrated by the use of this CO-containing regenerator off-gas to help circulate the solid particles and to provide process heat to the thermal stage.

What is claimed is:

1. A two stage process for converting a residua feedstock to lower boiling products wherein the first stage is an upgrading stage wherein the Conradson Carbon content and metals content of a residua feedstock is lowered and the second stage is a catalytic cracking stage containing a reactor and a catalyst regenerator, wherein the upgrading is performed in a short vapor contact time thermal process unit comprised of:

(i) a heating zone wherein solids containing carbonaceous deposits are received from a stripping zone and heated in the presence of an oxidizing gas;

(ii) a short vapor contact time reaction zone containing a horizontal moving bed of fluidized hot solids recycled from the heating zone, which reaction zone is operated at a temperature from about 450° C. to about 650° C. and operated under conditions such that the solids residence time is from about 5 to about 60 seconds and the vapor residence time is less than about 2 seconds; and (iii) a stripping zone through which solids having carbonaceous deposits thereon are passed from the reaction zone and wherein lower boiling additional hydrocarbon and volatiles are stripped with a stripping gas;

which process comprises:

(a) feeding the residua feedstock, in liquid form, to the short vapor contact time reaction zone wherein it contacts fluidized hot solids, thereby depositing high Conradson Carbon components and metal-containing components thereon, and producing a vaporized product stream;

(b) separating the vaporized product stream from the fluidized solids;

(c) feeding said vaporized product stream to a fluid catalytic cracking reactor where it is catalytically converted to lower boiling products;

(d) passing the solids to said stripping zone where they are contacted with a stripping gas, thereby removing volatile components therefrom;

(e) passing the stripped solids to a heating zone along with CO-containing flue gas from the fluid catalytic cracker regenerator, where they are heated to a temperature effective to maintain the heat requirements of the short vapor contact time reaction zone; and (f) recycling hot solids from the heating zone to the reaction zone where they are contacted with fresh feedstock.

2. The process of claim 1 wherein the CO-containing flue gas from the fluid catalytic cracker regenerator is combusted to raise its temperature prior to its being passed to said heating zone.

3. The process of claim 1 wherein the vaporized product stream is quenched to a temperature below which thermal cracking will occur before being fed to a fluid catalytic cracking process unit.

4. The process of claim 1 wherein the vapor residence time of the short vapor contact time reaction zone is less than about 1 second.

5. The process of claim 1 wherein the residua feedstock is selected from the group consisting of vacuum resids, atmospheric resids heavy and reduced petroleum crude oil.

6. The process of claim 5 wherein the residua feedstock is a vacuum resid.

7. The process of claim 3 wherein the solids residence time of the short vapor contact time reaction zone is from about 10 to 30 seconds.

8. The process of claim 1 wherein the particles of the short vapor contact time reaction zone are fluidized with the aid of a mechanical means.

9. The process of claim 8 wherein the mechanical means are comprised of two of horizontally disposed screws within the reactor.

* * * * *